US005866022A

United States Patent [19]

Hall

[11] Patent Number: 5,866,022

[45] Date of Patent: Feb. 2, 1999

[54] REFRACTORY POUR TUBE WITH CAST PLATE

[75] Inventor: Richard G. Hall, Hiram, Ohio

[73] Assignee: North American Refractories Company, Ohio

[21] Appl. No.: 822,808

[22] Filed: Mar. 24, 1997

[51] Int. Cl.[6] ..... B22D 35/00

[52] U.S. Cl. ..... 222/600; 222/606

[58] Field of Search ..... 222/590, 600, 222/603, 606, 607, 591; 164/337, 437, 335

[56] References Cited

U.S. PATENT DOCUMENTS

| | | | |
|---|---|---|---|
| 3,899,018 | 8/1975 | Koenig . | |
| 4,108,675 | 8/1978 | Tomita et al. . | |
| 4,179,046 | 12/1979 | Jwschke et al. . | |
| 4,220,271 | 9/1980 | Szadhowski . | |
| 4,640,447 | 2/1987 | Geller et al. . | |
| 4,669,528 | 6/1987 | Szadkowski . | |
| 4,738,380 | 4/1988 | King . | |
| 4,746,037 | 5/1988 | Harasym . | |
| 4,951,851 | 8/1990 | King et al. . | |
| 4,995,535 | 2/1991 | Ooya et al. . | |
| 5,092,500 | 3/1992 | Weber et al. . | |
| 5,198,126 | 3/1993 | Lee . | |
| 5,205,343 | 8/1993 | Steubel et al. . | |
| 5,335,833 | 8/1994 | Rancoule . | |
| 5,348,202 | 9/1994 | Lee . | |
| 5,370,370 | 12/1994 | Benson . | |
| 5,373,976 | 12/1994 | Rancoule et al. | 222/600 |
| 5,614,121 | 3/1997 | Terao et al. | 222/603 |
| 5,681,499 | 10/1997 | Benson et al. | 222/606 |
| 5,691,061 | 11/1997 | Hanse et al. | 222/606 |

FOREIGN PATENT DOCUMENTS

| | | |
|---|---|---|
| 080 672 | 11/1982 | European Pat. Off. . |
| 171 487 | 8/1984 | European Pat. Off. . |
| 198 123 | 4/1985 | European Pat. Off. . |
| 0 198 237 | 10/1986 | European Pat. Off. . |
| 28 16 283 | 10/1978 | Germany . |
| 56-14060 | 2/1981 | Japan . |
| 62-158562 | 7/1987 | Japan . |
| 1528607 | 12/1987 | U.S.S.R. . |
| 1157818 | 7/1969 | United Kingdom . |
| 1 576 778 | 4/1977 | United Kingdom . |
| 2 065 850 | 7/1981 | United Kingdom . |
| 2 179 573 | 3/1987 | United Kingdom . |

*Primary Examiner*—Scott Kastler
*Attorney, Agent, or Firm*—Watts, Hoffmann, Fisher & Heinke, Co., L.P.A.

[57] ABSTRACT

A refractory pour tube with a wear resistant plate includes a one-piece composite member formed of different refractory compositions, a casing disposed around a portion of the member, and castable refractory material disposed within the casing. The composite member has a tubular body portion defining an interior bore and an end portion defining a flat plate surface including an opening communicating with the bore. The end portion is formed of a hard refractory composition resistant to abrasion, while the tubular body portion is formed of a refractory composition resistant to thermal shock. First and second castable refractory materials are poured into the casing to form a refractory ring surrounding the flat plate surface and a refractory sleeve surrounding the tubular body portion. The refractory ring cooperates with the flat plate surface to form a hard, wear resistant plate suitable for use in a sliding valve assembly. The refractory sleeve insulates the casing from heat and, along with the refractory ring, secures the casing to the composite member. Manufacture of the pour tube requires minimal machining and is simplified and less expensive than formation of prior art pour tubes.

18 Claims, 1 Drawing Sheet

REFRACTORY POUR TUBE WITH CAST PLATE

BACKGROUND OF THE INVENTION

1. Field of the Invention

The present invention relates generally to refractory pouring assemblies for pouring molten metal during a continuous casting process. More particularly, the invention relates to a refractory pour tube for use in such assemblies.

2. Description of Related Art

Refractory pouring assemblies for transferring melt, i.e., molten metal, are known in the art. For example, in a typical casting process, the melt is transferred from a ladle to a tundish, and from the tundish to a mold. The ladle and tundish each have a bottom wall with a port through which the melt exits. A valve assembly of some type is provided to control the flow of melt from the ladle to the tundish, and from the tundish to the mold. In order to transfer the melt from such bottom pouring metallurgical vessels, the valve assembly is provided with a refractory pour tube having upper and lower ends for receiving and discharging the melt.

One known valve assembly includes a plate fixed to the exterior surface of the bottom wall of the vessel, the plate having an opening aligned with the port in the vessel wall. A combined tube and plate assembly is secured beneath the fixed plate and is selectively alignable with the opening in the fixed plate. During a casting process, the valve is actuated to its open position and the melt exits the vessel through the opening in the plate and passes into the pour tube. See, for example, the pouring assemblies disclosed in U.S. Pat. Nos. 5,348,202, 5,198,126 and 4,746,037.

In conventional refractory pouring assemblies that include a combined pour tube and plate, the plate is formed of an abrasion resistant composition in order to protect the plate during relative sliding against a mating valve plate. Additionally, forming the plate of a hard, wear resistant composition ensures that the peripheral edge around the opening in the plate is hard enough to cut through a metal shell formed in the tube. The body portion of the tube, which is not subjected to sliding abrasion, typically is formed of a refractory composition that is softer and more resistant to thermal shock.

As is known in the art, aspiration of air through the pouring assembly should be avoided because it results in build up of alumina deposits that clog the pouring tube or adversely affect the quality of the cast metal. However, prior art pour tube and plate assemblies formed from separate refractory elements include joints between the elements. This is undesirable because air can be aspirated through the joints, resulting in the problems mentioned above. In one known pour tube construction, a separately formed flat plate of wear resistant refractory is attached to a pour tube by a metal can. This arrangement does not always prevent aspiration of air through the assembly due to the joint between the plate and the tube. Further, air gaps and separation of components can arise during use due to the different rates of thermal expansion of the various materials forming the plate and tube.

In another combined pour tube and plate construction, the plate and tube are co-pressed from different refractory compositions to form a one-piece composite member. While this construction is more likely to prevent air aspiration, than one in which separate elements are joined by a can, manufacturing the composite tube and plate is expensive and requires precise machining. A metal can typically is used with this construction as well and directly contacts the exterior of the combined pour tube and plate. The exterior of the tube and plate thus must be precisely machined to fit properly within the can. This increases the cost and difficulty associated with producing such a construction. Accordingly, there is a need in the art for a refractory pour tube that overcomes shortcomings of the prior art.

SUMMARY OF THE INVENTION

The invention provides a refractory pour tube including a cast plate. The pour tube and plate comprise different refractory materials, but are formed as essentially a one-piece structure that is free of joints. Consequently, the pour tube of the invention prevents aspiration of air and related adverse effects, such as deposit build-up, clogging of the tubes and reduced quality cast metal. Also, the different refractory materials of the pour tube have relatively similar coefficients of thermal expansion to minimize the likelihood of air gaps being formed during use. In addition, the pour tube is easy to manufacture and requires minimal machining, and thus is less costly to produce than prior art pour tubes.

In a preferred embodiment, the refractory pour tube comprises a one-piece composite member having a tubular body portion and an end portion defining a flat plate surface. An opening is formed in the flat plate surface and communicates with a bore passing through the tubular body portion. The composite member is formed of different refractory compositions that exhibit different wear and/or thermal shock resistance properties, the composition forming the tubular body portion preferably being softer and more thermal shock resistant than the composition forming the end portion. The respective compositions preferably are isostatically co-pressed to form the one-piece composite member. A casing, preferably formed of metal, is disposed around the composite member and includes a sleeve section surrounding the tubular body portion and an annular mouth surrounding the end portion. A sleeve of castable refractory material is disposed between the sleeve section of the casing and the tubular body portion of the member, and a ring of castable refractory material is disposed between the mouth of the casing and the end portion of the member. The ring has an exterior surface which, along with the flat plate surface of the member, forms a wear resistant plate suitable for use in a sliding valve assembly.

In more specific preferred embodiments, the sleeve surrounding part of the tubular body portion is formed of one castable refractory material, while the ring surrounding the end portion is formed of another castable refractory material. The one castable material preferably is comparatively more of a heat insulator than the other castable material, which is comparatively harder and more wear resistant than the one material. The tubular body portion of the composite member preferably has a corrosion resistant protective band that contacts the slag line of the melt during use. While a bell-shaped casing with an enlarged mouth is preferred, other casing configurations may be utilized.

A preferred process for forming a refractory pour tube according to the invention includes steps of forming a one-piece, co-pressed composite member having a tubular body portion with a bore, and an end portion defining a flat plate surface including an opening, the opening communicating with the bore. The tubular body portion and the end portion of the member comprise different refractory compositions. The flat plate surface of the end portion of the member is placed against the base of a mold, and the casing is slid over the tubular body portion and into contact with the mold base. A first castable refractory material is poured into the space between the casing and the composite member and flows downward to the mold base to form a refractory ring surrounding the flat plate surface formed at the end portion of the member. A second castable refractory material then is poured into the casing to form a refractory sleeve surrounding a section of the length of the tubular body portion of the member.

Other features, benefits and advantages of the invention will be apparent from the following detailed description of preferred embodiments taken in conjunction with the following drawing Figures.

DETAILED DESCRIPTION OF PREFERRED EMBODIMENTS

Figure 1:
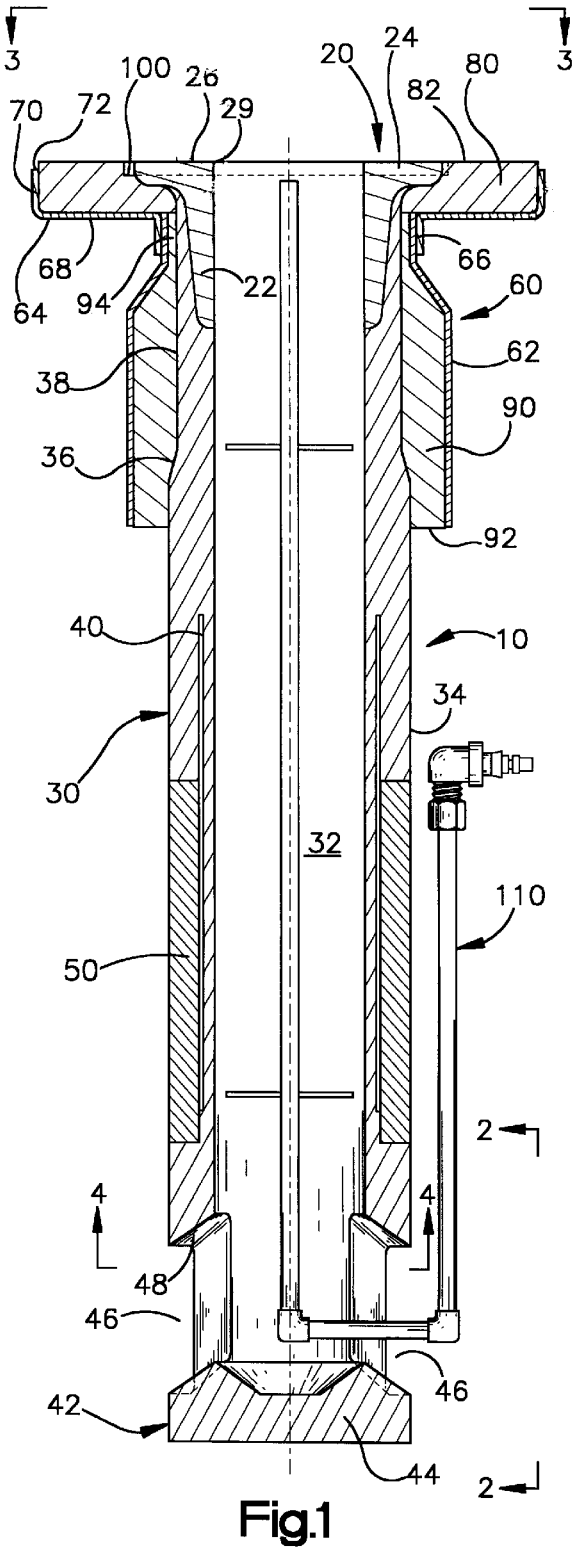
FIG. 1 is a front elevational view in section of a refractory pour tube constructed according to a preferred embodiment of the invention.

Referring to FIG. 1, a refractory pour tube constructed according to a preferred embodiment of the invention is shown to include a one-piece composite member 10 comprising an end portion, indicated generally by the reference numeral 20, for receiving melt (i.e., molten metal) from a metallurgical vessel such as a ladle or tundish (not shown), and a tubular body portion, indicated generally by the reference numeral 30. As discussed below, end portion 20 and tubular body portion 30 are formed of different refractory compositions that exhibit different wear resistance and thermal shock resistance properties.

The end portion 20 of composite member 10 includes an axial extending section 22 and a radially extending section 24. The radially extending portion 26 has a flat plate surface 26 that circumscribes an opening 28. The flat plate surface 26 includes a peripheral edge 29 that also circumscribes the opening 28 and is formed of a hard refractory material suitable for cutting through metal extending through the composite member 10.

Figure 4:
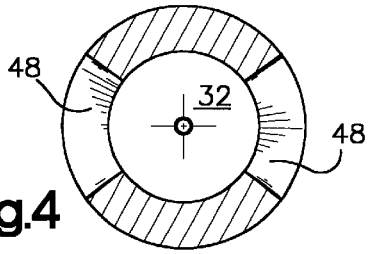
FIG. 4 is a sectional view of the pour tube depicted in FIG. 1, taken along arrows 4—4.
Figure 2:
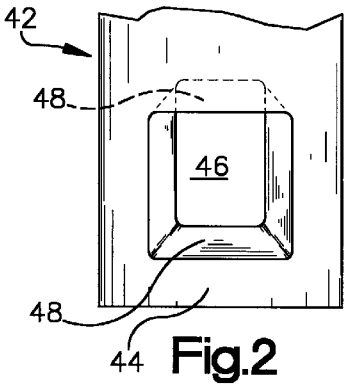
FIG. 2 is a fragmentary side elevational view of the pour tube depicted in FIG. 1, taken in the direction of arrows 2—2 and showing the discharge end of the tube.

The tubular body portion 30 of the composite member 10 includes an inner bore 32 and an outer surface 34. The outer surface 34 of the tubular body portion 30 includes a tapered or stepped area 36 leading to a reduced diameter portion 38 which, as explained below, serves to secure the components forming the pour tube against relative movement. The tubular body portion 30 has a discharge end 42 including an end wall 44 and one or more openings 46 from which melt exits the tube. FIG. 2 shows the openings 46 formed in the discharge end 42 of the composite member 10 for pouring the melt, for example, from a ladle to a tundish, or a tundish to a mold. The openings 46 are defined by angled surfaces 48 to facilitate pouring of the melt as is known in the art. As seen in FIG. 4, two openings 48 are provided in a preferred embodiment; however, the number of openings is not critical.

The composite member 10 preferably is formed by co-pressing different refractory compositions having different wear resistance and thermal shock resistance characteristics. For example, the member 10 may be formed by co-pressing various compositions in the manner taught by U.S. Pat. No. 5,348,202, the entire disclosure of which patent is incorporated herein by reference. Producing the composite member 10 by a co-pressing process is preferred because it forms in a single step a refractory component with required hardness and thermal shock resistance characteristics. More particularly, the end portion 20 of the composite member 10 is formed of a refractory composition exhibiting high hardness and wear resistance characteristics relative to the tubular body portion 30, while the tubular body portion 30 preferably is formed of a refractory composition exhibiting high thermal shock resistance characteristics relative to the end portion 20. The end portion 20 is formed of a hard, wear resistant refractory composition so that the flat plate surface 26 is able to withstand abrasion from relative sliding that occurs when the pour tube is used in a refractory sliding valve assembly.

The end portion 20 and the tubular body portion 30 of composite member 10 may be formed of various refractory compositions. A preferred refractory composition for the end portion 20 comprises alumina, graphite, zirconia, mullite and a relatively small amount of aluminum bonded with a phenolic resin, and a preferred refractory composition for the tubular body portion 30 comprises alumina and graphite bonded with a phenolic resin. In addition, the refractory compositions may selected as disclosed in U.S. Pat. No. 5,348,202, i.e., an alumina, silica, zirconia, carbon composition may form the end portion 20 of the composite member 10, and an alumina, silica, carbon composition may form the tubular body portion 30 of the composite member 10.

The composition used to form the end portion 20 of member 10, in addition to being hard and resistant to abrasion, preferably also is corrosion resistant as it contacts the melt. Further, as the composition used to form the end portion is a refractory material, it will possess some degree of thermal shock resistance. The composition used to form the tubular body portion 30 of the member 10 preferably is corrosion resistant as it too contacts the melt, and also preferably is fairly resistant to oxidation as the tube exterior is exposed to air. The composition used to form the tubular body portion 30 also will be resistant to thermal shock and, in a preferred embodiment, is softer and more thermal shock resistant than the end portion 20. As seen in FIG. 1, the tubular body portion 30 of the member 10 preferably carries a band 50 of wear resistant refractory material which is highly corrosion resistant in order to withstand exposure to the melt, and the slag on the top of the melt, when the pour tube is used as a submerged entry tube. The band 50 preferably is formed from a composition comprising zirconia, graphite and silicon metal bonded by a phenolic resin. The band 50 also may be formed from the compositions disclosed in U.S. Pat. No. 5,348,202.

An internal groove or slit 40 may optionally be provided in the tubular body portion 30 of the composite member 10 in order to facilitate flushing of an inert gas (such as Argon) to prevent aspiration of air into the bore 32, as is known in the art. Also, during use of the pour tube a gas lance, indicated by reference numeral 110, may extend into the bore 32 and have radial guides that align the lance in the bore. As is known in the art, lance 110 may be used to break through metal obstructing the port or opening in the various components of the pouring assembly, the lance being destroyed upon melt entering bore 32.

As seen in FIG. 1, a casing 60 is disposed around the composite member 10 and preferably comprises a sleeve section 62 and an annular mouth 64. The sleeve section 62 and the annular mouth 64 may be formed separately and then joined by a suitable connection indicated at 66, for example, by welding, metallic bonding, etc. The casing 60 preferably is a metal can and generally bell-shaped with the mouth 64 enlarged with respect to the sleeve section 62. The mouth 64 of the casing 60 includes a horizontal wall 68 that extends radially outward and leads to an upturned wall 70 terminating in an outer edge 72. The casing 60 surrounds part of the length of composite member 10 so as to define a space between the interior of the casing and the exterior of the member. The space may be viewed as including two areas, a first area located between the end portion 20 and the annular mouth 64, and a second area disposed between the tubular body portion 30 and the sleeve section 62.

According to the invention, the annular mouth 64 of the casing 60 is filled with castable refractory material to form a refractory ring indicated by reference numeral 80. Similarly, the sleeve section 62 of the casing 60 is filled with castable refractory material to form a refractory sleeve indicated by reference numeral 90. The refractory ring 80 includes a flat exterior surface 82 surrounding the flat plate surface 26 of the end portion 20 of the composite member 10. Accordingly, the pour tube of the invention includes a wear resistant plate at one end that is formed by the flat plate surface 26 of the end portion 20 of member 10, and by the exterior surface 82 of the refractory ring 80.

The sleeve section 62 of the casing 60 is filled with castable refractory material to form the refractory sleeve 90 that surrounds the upper part of the tubular body portion 30 (as well as some of the axially extending section 22 of the end portion 20). In addition to filling the void between the casing 60 and the tubular body portion 30, the sleeve 90 secures the casing to the member 10, as discussed below. While it is possible to form the refractory ring 80 and the refractory sleeve 90 from the same castable refractory material, it is preferred to utilize different materials. In particular, the castable material used to form the refractory ring 80 preferably is strong and resistant to abrasion. Thus, the plate formed at the melt-receiving end of the pour tube of the invention is hard and resistant to abrasion. A suitable castable refractory Material for forming the ring 80 comprises alumina and magnesium aluminate bonded with calcium aluminate cement. The refractory material used to form the refractory sleeve 90 preferably is a good heat insulator so as to minimize conduction of heat from the composite member 10 to the casing 60. A suitable castable refractory material for forming the ring 80 is NARCON 93, which is produced by North American Refractories Co., of Cleveland, Ohio, and a suitable castable refractory material for forming the sleeve 90 is HPV-3000, also produced by North American Refractories Co., of Cleveland, Ohio.

The refractory ring 80 and the refractory sleeve 90 also secure the casing 60 in place around the composite member 10. As seen in FIG. 1, the tapered portion 36 of the tubular body portion 30 leads to the reduced diameter portion 38 and prevents downward movement of the casing 60 and the refractory sleeve 90 relative to the member 10. Relative movement between these elements is undesirable because it may result in gaps through which air may be aspirated during pouring of the melt, the adverse consequences of which are discussed above. In addition, the radially extending portion 24 of the end portion 20 of the composite member 10 prevents upward movement of the casing 60 and the refractory ring 80 relative to the member 10. Accordingly, the composite member 10, refractory ring 80, refractory sleeve 90, and casing 60 remain securely locked together and prevent aspiration of air into the pour tube of the invention. Further, the refractory materials forming the member 10, the ring 80, and the sleeve 90 preferably have similar coefficients of thermal expansion and do not exert significant stress against each other during use, thereby further reducing the possibility of gaps forming through which air may be aspirated.

Figure 3:
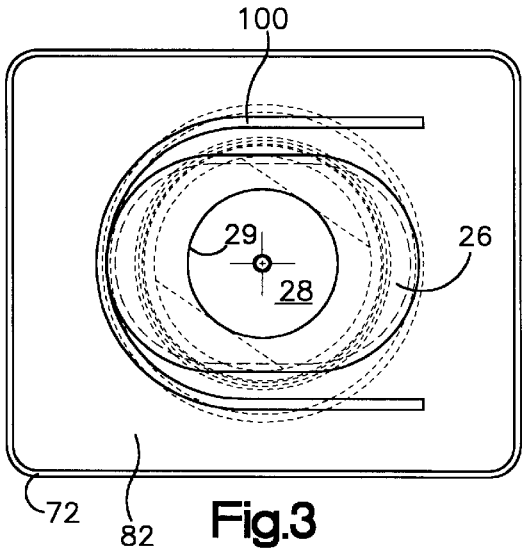
FIG. 3 is a plan view of the pour tube depicted in FIG. 1, taken in the direction of arrows 3—3 and showing the end of the tube provided with a wear resistant plate.

FIG. 3 shows the wear plate formed by the flat plate surface 26 of the end portion 20 of the member 10, and the exterior surface 82 of the refractory ring 80. A groove or slot, e.g., a U-shaped groove 100, may be formed in the refractory ring 80 to provide a path for purging inert gas (such as Argon) to prevent air from contacting the melt, as is known in the art. As seen in FIG. 1, the edge 72 of the casing 60 preferably is slightly offset from the exterior surface 82 of the refractory ring 80 to prevent the edge 72 from snagging or catching on an adjacent plate of a sliding valve assembly (not shown).

The preferred process for forming the pour tube according to the invention now will be described. The composite member 10 preferably is formed by co-pressing various refractory compositions, as described above. The member 10 is machined to include the bore 32, discharge openings 46, portion 38, etc. The end portion 20 of the member 10 then is placed and centered against a support surface, such as the base of a mold (not shown). The casing 60 is slid over the discharge end 42 of the tubular body portion 30 of the member 10 and into contact with the mold base. In order to offset the edge 72 of the mouth 64 of the casing 60 from the surface 82 of the ring 80, the mold base preferably includes a raised area against which the edge 72 rests after sliding the casing over the member 10. A castable refractory material is poured into the interior of the casing 60 to form the refractory ring 80. If the same castable refractory material is used to form both the ring 80 and the sleeve 90, the pouring step continues until the interior of the sleeve section 62 of the casing 60 is filled with a desired amount of the material to form the sleeve 90. Upon setting, the pour tube is removed from the mold.

In the preferred embodiment, as explained above, the refractory ring 80 and the refractory sleeve 90 are formed of different castable materials. Thus, in the preferred process, after the composite member 10 has been formed to its desired configuration and placed in a mold, a sufficient amount of a first castable refractory material is poured into the casing 60 so as to form a refractory ring 80 that preferably extends to or near the juncture between the sleeve section 62 and the annular mouth 64 of casing 60; however, the exact location at which the ring 80 ends (and the sleeve 90 begins) may be varied. Next, a second castable refractory material is poured into the interior of the casing 60 to form the refractory sleeve 90, the amount of material poured determining the extent to which sleeve 90 extends along the tubular body portion 30 of the member 10. The second castable material may be poured into the casing during or after setting of the first castable material.

The pour tube of the invention provides considerable advantages over prior art devices. The combination of a one-piece composite member and a castable refractory sleeve and ring results in essentially a joint-free construction that eliminates aspiration of air and related problems. Also, utilizing refractory materials having similar thermal expansion characteristics prevents air aspiration caused by separation of components during use. In addition, the pour tube of the invention is easier to produce than prior art pour tubes which require substantial machining in order to fit properly in the metal casing, a proper fit being required to prevent aspiration of air. According to the invention, castable refractory material is poured into the casing and conforms to the outer configuration of the composite member, as well as the interior configuration of the casing, to form a refractory ring and sleeve. Therefore, precise machining of the composite member is not required as in prior art pour tubes, and thus the pour tube of the invention can be produced with less difficulty and cost.

The pour tube of the invention has been described in connection with the wear plate cooperating with an adjacent plate comprising part of a sliding valve assembly; however, it will be appreciated that the invention is not solely limited to use in a sliding valve assembly. Also, those skilled in the art will recognize that it is possible to adapt the invention for use as a refractory collector nozzle. The pour tube of the invention is suitable for use with known tube changer mechanisms that replace worn out pour tubes. It should also be understood that relative terms, such as "upper" and "lower," used in the foregoing description are for sake of clarity in describing the pour tube as depicted in the Figures, and not in a manner that limits the construction, application or use of the invention.

Although the invention has been described in detail with respect to the illustrated embodiment, it will be appreciated that many variations are possible. For example, the casing preferably is a metal can but instead could be formed of a different material. The casing also may be a single integral element rather than a sleeve section and an annular mouth fixed together; however, for manufacturing reasons, it is preferred to form the sleeve section and the annular mouth separately and attach them to each other. Also, while a casing with an enlarged annular mouth is preferred in order to form a refractory ring having a relatively large exterior surface, the exact dimensions of the annular mouth relative to the sleeve section of the casing may be altered. Further, while a bell-shaped casing is preferred, the casing may instead be straight, oval, round or any other shape. The specific refractory compositions and materials used to form the composite member and the refractory ring and sleeve of the inventive pour tube may be varied depending on the particular application. In addition, while two different castable refractory materials are preferred to form the ring and the sleeve, one castable material may be used to form both elements.

Accordingly, while the invention has been described in detail with reference to preferred embodiments thereof, it will be appreciated by those skilled in the art that other variations and modifications are possible without departing from the scope of the invention as defined by the claims.

What is claimed is:

1. A refractory pour tube comprising:

a one-piece composite member formed of different refractory compositions that exhibit different wear and thermal shock resisting properties, the composite member including a tubular body portion with a bore, and an end portion defining a flat plate surface with an opening and an edge surrounding the opening, the opening communicating with the bore;

wherein the end portion is formed from a refractory composition that is comparatively harder than said tubular body portion, and the tubular body portion is formed from a refractory composition that is comparatively softer and more thermal shock resistant than said end portion;

a casing surrounding the composite member;

a sleeve of castable refractory material disposed between the casing and the tubular body portion of the composite member; and a ring of castable refractory material disposed between the casing and the end portion of the composite member, the ring including an exterior surface surrounding the flat plate surface of the composite member.

2. A refractory pour tube according to claim 1, wherein the sleeve and ring are formed of different castable refractory materials.

3. A refractory pour tube according to claim 2, wherein the castable refractory material forming the ring has greater wear resistance than the castable refractory material forming the sleeve.

4. A refractory pour tube according to claim 1, wherein the refractory composition forming the tubular body portion comprises alumina and graphite, and the refractory composition forming the end portion comprises alumina, graphite, fused zirconia mullite and aluminum.

5. A refractory pour tube according to claim 1, wherein the exterior surface of the ring completely surrounds the flat plate surface of the composite member.

6. A refractory pour tube according to claim 5, wherein the casing is generally bell-shaped with an annular mouth surrounding the ring.

7. A refractory pour tube according to claim 6, wherein the annular mouth of the casing has an outer edge that is offset from the exterior surface of the ring.

8. A refractory pour tube according to claim 1, wherein the casing includes a straight section surrounding the sleeve of castable refractory material and an enlarged annular mouth surrounding the ring of castable refractory material.

9. A refractory pour tube according to claim 8, wherein the tubular body portion of the composite member includes a reduced diameter portion disposed within the straight section of the casing, and the end portion of the composite member includes a radially extending portion disposed with the annular mouth of the casing.

10. A refractory pour tube according to claim 1, wherein the casing is a metal can.

11. A refractory pour tube according to claim 1, wherein a section of the tubular body portion of the composite member is surrounded by a corrosion resistant band.

12. In a refractory pour tube formed as a substantially joint-free, one-piece composite member from different refractory materials which exhibit different wear and thermal shock-resisting properties, the member including a tubular body portion and an end portion that defines a flat plate surface having a pour opening communicating with an interior of said tubular body portion, said end portion being formed from a refractory composition that is comparatively harder than said tubular body portion, and said tubular body portion being formed from a refractory composition that is comparatively softer and more thermal shock resistant than said end portion, the improvement comprising: a can at the upper end of said pour tube, a refractory sleeve in said can around said tubular body portion, and a refractory ring in said can around said end portion, said refractory ring having an exposed surface surrounding and forming a continuation of said flat plate surface.

13. A refractory pour tube according to claim 12, wherein the refractory sleeve and refractory ring are formed of different refractory materials having different hardness and thermal shock characteristics.

14. A process for forming a refractory pour tube, the process comprising steps of:

forming a one-piece composite member having a tubular body portion and an end portion, the end portion defining a flat plate surface with an opening formed therein and a peripheral edge surrounding the opening, and the tubular body portion having a bore that communicates with the opening in the flat plate surface;

forming the end portion of the composite member of a refractory composition that is comparatively harder than the tubular body portion;

placing a casing around the composite member to define a space between an interior of the casing and the tubular body portion and between the interior of the casing and the end portion; and pouring a castable refractory material into the interior of the casing to form a refractory sleeve around the tubular body portion of the composite member, and a refractory ring around the end portion of the composite member, the refractory ring having an outer surface cooperating with the flat plate surface to form a wear resistant plate at one end of the pour tube.

15. A process according to claim 14, wherein the step of pouring a castable refractory material comprises pouring a first castable refractory material to form the refractory ring and pouring a second castable refractory material to form the refractory sleeve, the first and second castable refractory materials having different hardness and thermal shock characteristics.

16. A process according to claim 15, wherein the step of pouring a castable refractory material is carried out by positioning the flat plate surface of the composite member against a support, sliding the casing over the tubular body portion until the casing contacts the support, and then pouring the first and second castable refractory materials into the casing.

17. A process according to claim 14, wherein the casing has an enlarged annular mouth that is filled with the castable refractory material to form the refractory ring.

18. A process according to claim 14, wherein the composite member is formed by an isostatic co-pressing process.

* * * * *